US006357386B1

(12) United States Patent
Keller

(10) Patent No.: US 6,357,386 B1
(45) Date of Patent: Mar. 19, 2002

(54) ASSEMBLY FOR CONTROLLING THE GAS FLOW IN A PLASMA SPRAYING APPARATUS

(75) Inventor: Silvano Keller, Boettstein (CH)

(73) Assignee: Sulzer Metco AG, Wohlen (CH)

( * ) Notice: Subject to any disclaimer, the term of this patent is extended or adjusted under 35 U.S.C. 154(b) by 0 days.

(21) Appl. No.: 09/449,206

(22) Filed: Nov. 24, 1999

(30) Foreign Application Priority Data

Dec. 24, 1998 (CH) ..... 19982568/98

(51) Int. Cl.[7] ..... B05C 5/02

(52) U.S. Cl. ..... 118/723 VE; 118/50; 118/603; 118/610

(58) Field of Search ..... 118/723 E, 50, 118/312, 323, 326, 603, 610; 427/446, 450–456; 219/121.47

(56) References Cited

U.S. PATENT DOCUMENTS

| | | | | |
|---|---|---|---|---|
| 3,100,724 A | | 8/1963 | Rocheville | |
| 4,689,468 A | * | 8/1987 | Muehlberger | 219/76.16 |
| 4,775,547 A | * | 10/1988 | Siemers | 427/446 |
| 4,919,745 A | * | 4/1990 | Fukuta et al. | 156/345 |

FOREIGN PATENT DOCUMENTS

| | | |
|---|---|---|
| DE | 1962698 A | 6/1971 |
| DE | 3704551 C1 | 5/1988 |
| DE | 3740498 A1 | 6/1989 |
| GB | 815804 | 7/1959 |
| JP | 05179417 | 7/1993 |
| JP | 08199372 | 8/1996 |
| JP | 08209322 | 8/1996 |

* cited by examiner

*Primary Examiner*—Laura Edwards
(74) *Attorney, Agent, or Firm*—Tarolli, Sundheim, Covell, Tummino & Szabo L.L.P.

(57) ABSTRACT

A plasma spraying assembly comprising a treatment chamber and a plasma spraying device located in the interior thereof is disclosed that further comprises an assembly for controlling the gas flow in the interior of the treatment chamber. In order to prevent a gas flow in the interior of the treatment chamber that whirls deposits to be created, a deflection device is provided that is located at least partially in the interior of the treatment chamber. Vertically below the treatment chamber, a collecting shaft is located. In the region between the treatment chamber and the collecting shaft, there is provided a basic element comprising baffle members, but leaving open a passage between the treatment chamber and the collecting shaft. In the interior of the collecting shaft, a deflection element is located having essentially conical shape and towering into the passage of the basic element. The collecting shaft is in operative connection with the suction side of a blower and with a vacuum pump.

15 Claims, 5 Drawing Sheets

ASSEMBLY FOR CONTROLLING THE GAS FLOW IN A PLASMA SPRAYING APPARATUS

BACKGROUND OF THE INVENTION

The present invention refers to an assembly for controlling the gas flow in a plasma spraying apparatus that comprises a treatment chamber and a plasma spraying device located in the interior of the treatment chamber.

For plasma coating of substrates, in most cases a plasma spraying apparatus is used that comprises a treatment chamber in the interior of which an atmosphere is created that is most suitable for a particular coating operation. Thereby, a plasma jet is generated by means of a plasmatron. In that plasma jet, the coating material to be applied to the surface of a substrate is molten. The plasma jet can reach a very high velocity, up to the ultrasonic region. However, in the interior of the treatment chamber, a gas flow is created during the operation of the plasmatron, particularly caused by the plasma jet. Such a gas flow can have a negative influence on the purity of the surface of the substrate as well as on the quality of the coating applied to the surface of the substrate.

The negative effect of such a gas flow in the interior of the treatment chamber is that loose deposits as dust, coating powder, spraying material residues and the like are whirled off the walls of the treatment chamber. Thereby, these deposits can reach the surface of the substrate to be coated and contaminate it. Moreover, whirled deposits can displace into the plasma jet and are entrained therewith. In the interior of the plasma jet, those impurities are heated and partially molten such that they are, together with the real coating material, applied to the surface of the substrate. It is understood, one the one hand, that a contamination of the surface of a substrate has a negative effect on the adhesion of the coating to be applied, and, on the other hand, that those impurities molten in the plasma jet influence the quality of the coating applied to the surface of the substrate to the worse.

OBJECTS OF THE INVENTION

It is therefore an object of the invention to provide a plasma spraying assembly for treating the surfaces of substrates by means of which the adhesion and the quality of the coating applied to the surfaces of the substrates is substantially improved.

SUMMARY OF THE INVENTION

To meet these and other objects, the present invention provides a plasma spraying assembly for treating the surfaces of substrates, comprising a treatment chamber, a vacuum pump operatively connected to the treatment chamber and adapted to create a subatmospheric pressure in the interior of the treatment chamber, and a plasma spraying device mounted in the interior of the treatment chamber.

Further, there is provided an assembly for controlling the gas flow in the interior of the treatment chamber, comprising a deflecting device located at least partially in the interior of the treatment chamber. The deflecting device includes a plurality of deflecting elements that are adapted to interfere with a gas flow in the interior of the treatment chamber.

In a preferred embodiment, the assembly for controlling the gas flow in the interior of the treatment chamber includes a collecting shaft located next to the treatment chamber and communicating therewith, whereby a basic element is located in the transition area between the treatment chamber and the collecting shaft. The basic element is provided with first baffle members and a passage for a gas exchange between the treatment chamber and the collecting shaft. A deflection element having essentially conical shape towers at least partially into the passage provided in the basic element.

BRIEF DESCRIPTION OF THE DRAWINGS

In the following, an embodiment of the assembly according to the invention will be further described, with reference to the accompanying drawings, in which.

DETAILED DESCRIPTION OF A PREFERRED EMBODIMENT

Figure 1:
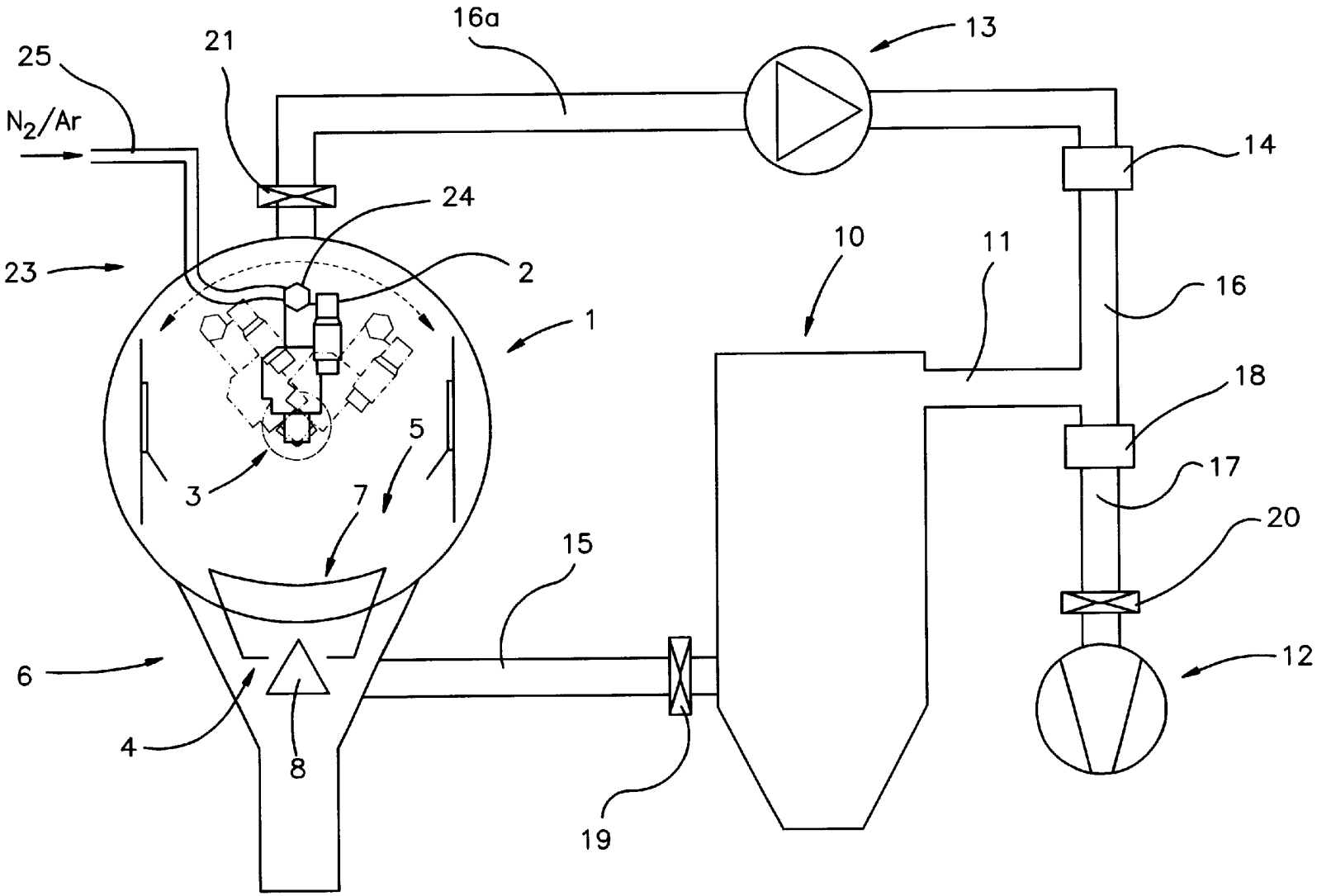
FIG. 1 shows a diagrammatic view of a plasma spraying apparatus including the assembly for controlling the gas flow according to the invention.

First, the general design of a plasma spraying apparatus including the assembly for controlling the gas flow according to the present invention will be further described with reference to FIG. 1. Since the basic principles of plasma spraying apparatuses comprising a treatment chamber and a plasma spraying device mounted in the interior thereof are well known to any person skilled in the art, only the elements and characteristics will be discussed in detail that are essential for the present invention.

The plasma spraying apparatus comprises a treatment chamber 1 and a plasma spraying device 2 adapted to coat a substrate (not shown), located in the interior of the treatment chamber 1. Below the treatment chamber 1, a collecting shaft 6 is provided. Moreover, a deflecting device 5, a filter member 10 for removing coarse particles, two filter members 14, 18 for removing fine particles, a vacuum pump 12, a circulation blower 13 as well as a pneumatic cleaning device 23 are illustrated in FIG. 1.

The plasma spraying device 2 is suspended on a mechanism 3 that is movable along several axes running in different directions and is located in the interior of the treatment chamber 1 of essentially cylindrical shape. In the transition area between the treatment chamber 1 and the collecting shaft 6, a basic element 7 is located that comprises deflecting elements to be described in more detail herein after. The basic element 7 is designed such that it provides for a passage 4 between the treatment chamber 1 and the collecting shaft 6. In the interior of the collecting shaft 6, a deflection element 8 is located that has essentially conical shape, whereby the tip of the cone towers into the passage 4 of the basic element 7.

The collecting shaft 6 is connected to the filter member 10 for removing coarse particles by means of a first conduit 15. A second conduit 16 leads from the outlet 11 of the filter member 10 for removing coarse particles to the suction side of the circulation blower, and a third conduit 17 leads from the outlet 11 of the filter member 10 for removing coarse particles to the vacuum pump 12. In both conduits 16 and 17, in each case a filter 14 and 18, respectively, for removing fine particles is inserted. A further conduit 16*a* connects the delivery side of the circulation pump 13 to the treatment chamber 1, whereby the further conduit 16*a* opens into the interior of the treatment chamber 1 at its top side. By means of the circulation pump 13, gases can be sucked off the treatment chamber 1 via the collecting shaft 6; these gases first are freed from coarse particles in the filter member 10 and then from fine particles in the filter member 14. The cleaned gases can be led back to the treatment chamber 1 via the further conduit 16*a*.

The vacuum pump 12 serves for creating a subatmospheric pressure in the interior of the treatment chamber 1 as well as for maintaining a predetermined subatmospheric pressure in the interior of the treatment chamber 1 during the coating operation. In order to enable the conduit 15 to be blocked or released, a gate valve 19 is inserted into the conduit 15. In order to enable the conduit 16*a* to be blocked or released, a gate valve 21 is inserted into the conduit 16*a*, and in order to enable the conduit 17 to be blocked or released, a gate valve 20 is inserted into the conduit 17.

To remove loose deposits as coating powder, dust, spraying residues and the like from the interior of the treatment chamber 1, a pneumatic cleaning device 23 is provided. If required, such loose deposits can be blown away and transported into the collecting shaft 16 by means of the pneumatic cleaning device 23. The pneumatic cleaning device 23 comprises a feed conduit 25 that opens into a blowing tube member 24 provided with a plurality of outlet apertures. The blowing tube member 24 is located at the top of the movable mechanism 3. As a gas for blowing away the deposits mentioned earlier, preferably nitrogen or argon is used.

Figure 2:
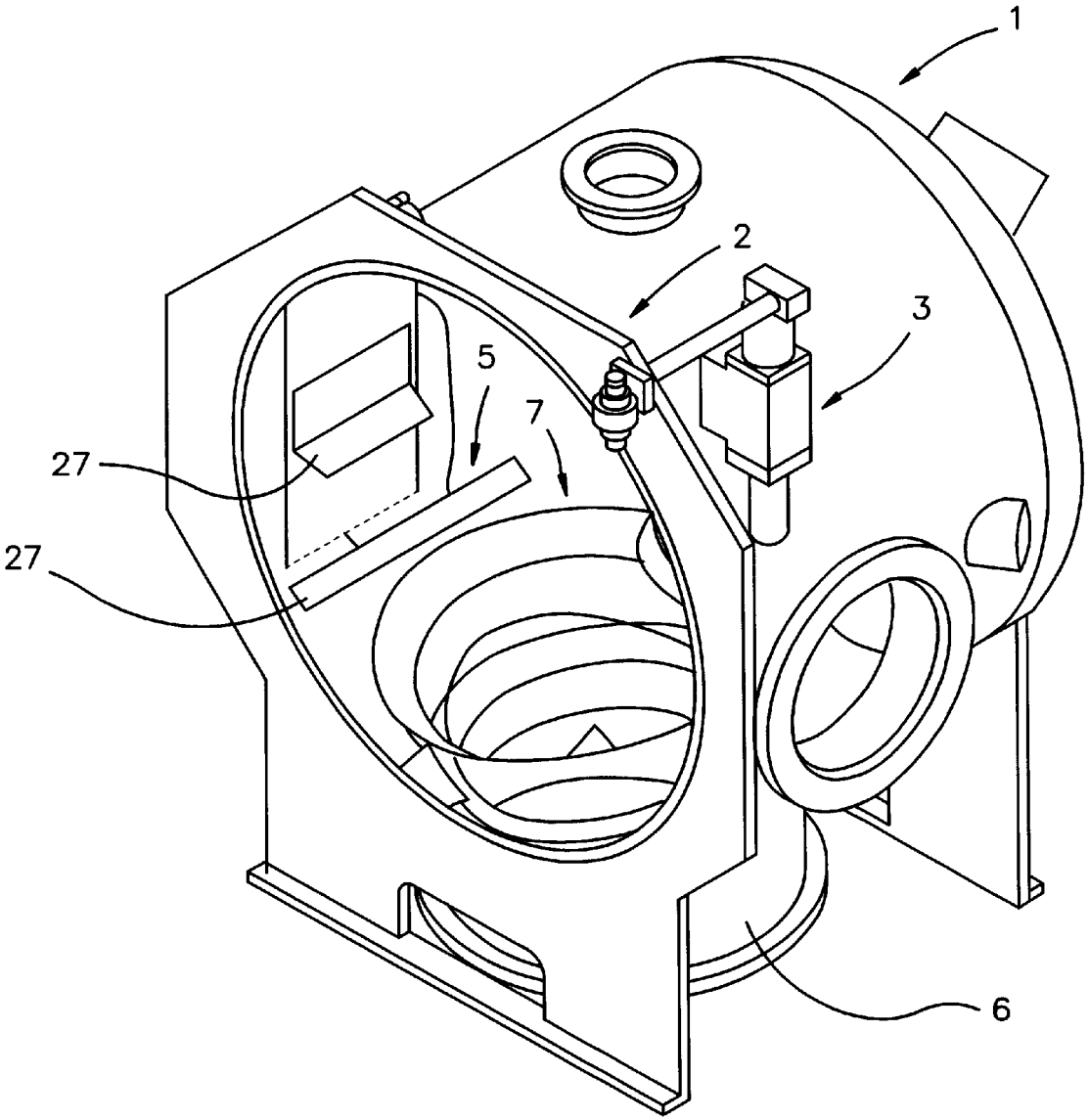
FIG. 2 shows an embodiment of a treatment chamber in a perspective, partially transparent view.

FIG. 2 shows in a perspective and partially transparent view the general design of the treatment chamber together with the plasma spraying device 2 and the basic element 7 located in the collecting shaft 6. The basic element 7 is part of a deflecting device, generally designated by reference numeral 5. Moreover, the deflecting device 5 comprises additional deflecting means interfering with the flow of the gases; that additional deflecting means can be realized in the form of baffle members 27 fixed to the inner side walls of the treatment chamber 1. In order to enable the treatment chamber 1 to be sealingly closed, a rotatably supported door is provided that is, however, not shown in the drawings for the sake of a clear illustration.

The main purpose of the basic element 7 is to pick up excess coating material that passes the substrate during the coating operation. Moreover, the basic element 7 prevents collected particles from moving back into the treatment chamber 1. Furthermore, the basic element 7, together with the deflection element 8 and the baffle members 27, has the effect that the flow of gases caused by the coating jet of the plasma spraying device 2 is interrupted and soothed, with the result that no unwanted circular gas flow is built up in the interior of the treatment chamber 1.

Figure 3:
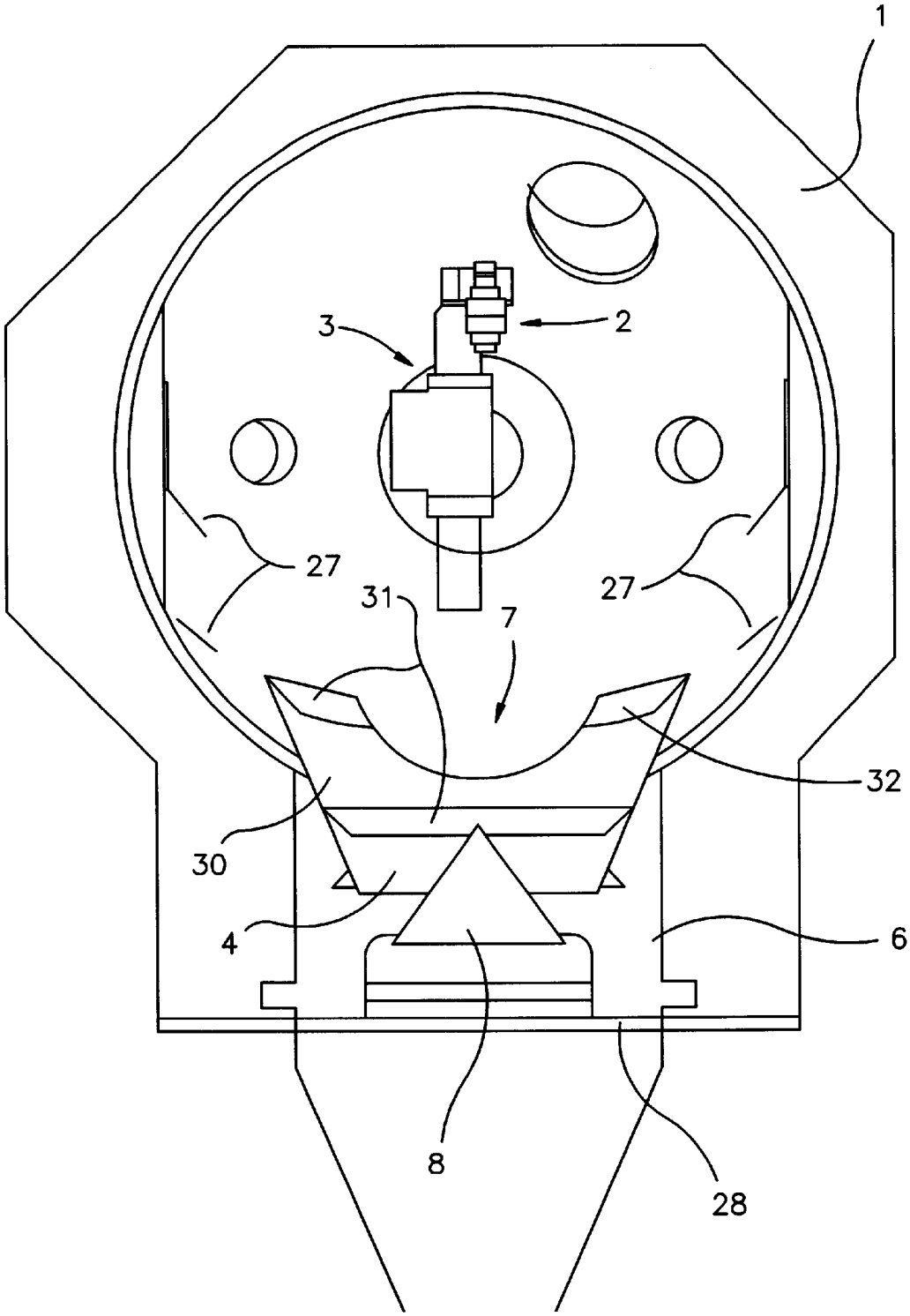
FIG. 3 shows a cross sectional view of the treatment chamber.
Figure 4:
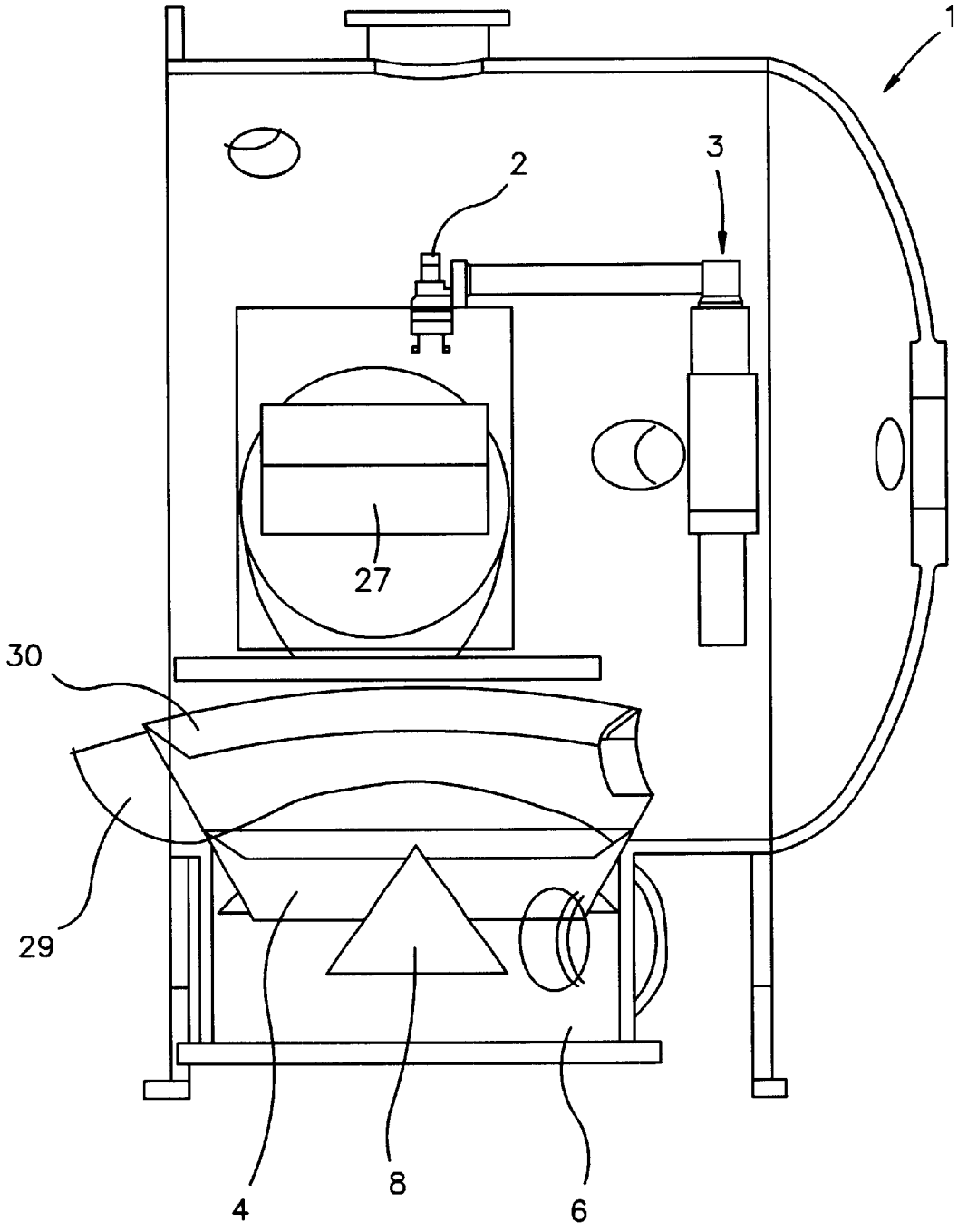
FIG. 4 shows a longitudinal sectional view of the treatment chamber.

The FIGS. 3 and 4 show the treatment chamber 1 in a cross sectional view and in a longitudinal sectional view, respectively. In these figures, it can be recognized that the basic element 7 is inserted into the collecting shaft 6 in such a way that the top side of the basic element 7 towers above the collecting shaft 6 and extends somewhat into the interior of the treatment chamber 1. The basic element 7 comprises a substantially oval dish member 30 having a continuously decreasing diameter in the direction towards the collecting shaft 6. Between the dish member 30 and the central deflection element 8, there is an open passage 4 through which an exchange of gas between the treatment chamber 1 and the collecting shaft 6 can take place. The deflection element 8 is supported by a support member 28 in the shape of a cross such that the cross section of the collecting shaft 6 is hardly diminished and the flow of the gases is not impeded.

The inner side of the dish member 30 of the basic element 7 is provided with a plurality of baffle members 31 that are inclined towards the bottom of the dish member 30. Thus, at the back side of those baffle members 31, damming chambers 32 are formed. Moreover, a sheet metal member 29 is attached to the outside of the dish member 30 that towers into a free space between the inner side of the treatment chamber 1 and the outer side of the dish member 30, once the (not shown) door of the treatment chamber 1 is closed. Again, that sheet metal member 29 serves for interrupting and soothing the gas flow. The baffle members 27, provided at the inner wall of the treatment chamber 1 and located above the basic element 7, form damming chambers as well at their back sides.

Figure 5:
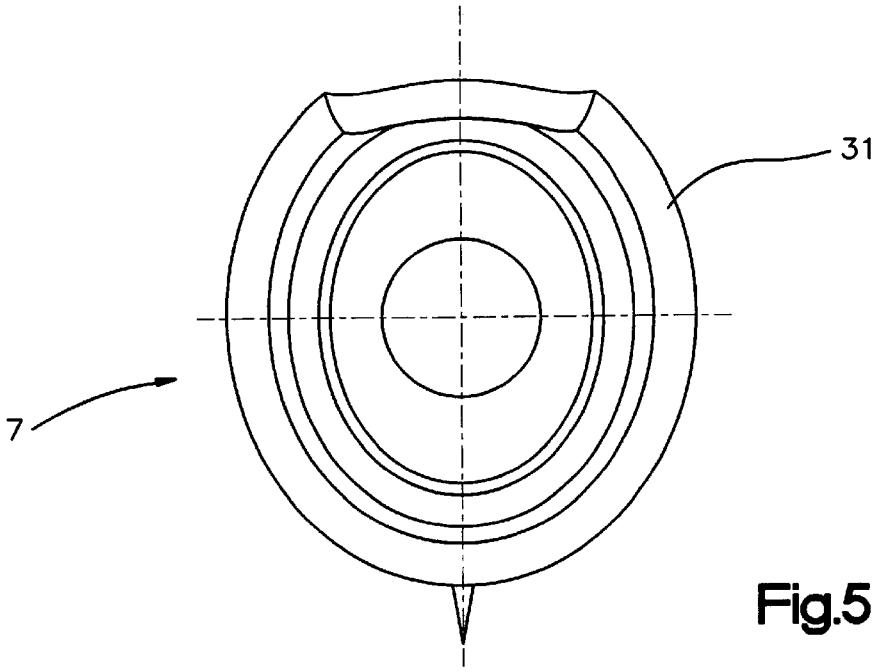
FIG. 5 shows a top view of an essential element of the assembly for controlling the gas flow.

FIG. 5 shows a top view of the basic element 7. This illustration clearly shows the essentially oval shape of the basic element 7 as well as the course of the baffle members 31. The recess at the back side of the basic member 7 improves the freedom of motion of the mechanism 3 located in the interior of the treatment chamber 1.

Figure 6:
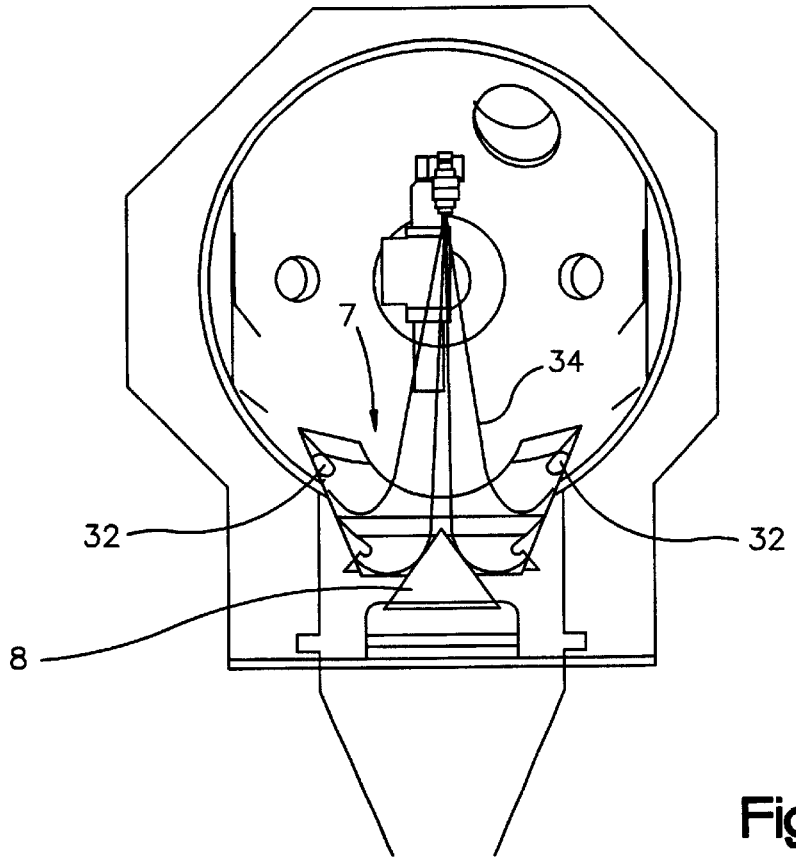
FIG. 6 shows a cross sectional view of the treatment chamber schematically illustrating the plasma coating jet.

FIG. 6 shows the treatment chamber 1 in a cross sectional view again, whereby a plasma coating jet 34 generated by the plasma spraying device 2 is illustrated. In the present example, the plasma coating jet is directed downwards towards the basic element 7. Thereby, as can be seen in FIG. 6, the plasma coating jet 34 is deflected and separated in the basic element 7 by means of the centrally located deflection element 8. Under the influence of the damming chambers 32 behind the baffle members 31 of the basic element 7, the coating particles entrained by the plasma coating jet 34 are trapped in the basic element 7 such that they cannot escape upwards from the basic element 7. If the plasma coating jet 34 is not directed vertically downwards as shown in FIG. 6, the baffle members 27 provided at the inner walls of the treatment chamber 1 prevent a circular flow of gases in the interior of the treatment chamber 1.

In practice, the plasma spraying assembly is operated as follows:

First, before the coating operation is started, the interior of the treatment chamber 1 is evacuated by means of the vacuum pump 12 (FIG. 1). During the coating operation, a predetermined subatmospheric pressure is maintained in the interior of the treatment chamber 1. For this purpose, the gate valve 20 in front of the vacuum pump 12 is opened and the gases entering the treatment chamber 1 during the operation of the plasma spraying device are continuously sucked off by means of the vacuum pump 12. Together with the sucked-off gases, also the excess coating particles as well as other particles whirled and entrained by the gas flow are removed from the interior of the treatment chamber 1. Coarser particles are removed from the gas by means of the filter 10, and finer particles are removed from the gas by means of the filter 18. After the coating operation has come to an end, the pressure in the interior of the treatment chamber 1 is increased to a value equaling atmospheric pressure such that the (not shown) door can be opened and the coated substrate can be removed from the interior of the treatment chamber 1.

It is understood that the treatment chamber 1 for the coating of substrates can be admitted with a non-reactive, preferably an inert gas.

In order to enable the interior of the treatment chamber 1 to be freed from deposits, the pneumatic cleaning device 23 is provided. At a time when no coating operation is in progress, loose deposits in the interior of the treatment chamber 1 can be blown away and transported into the collecting shaft 6 by means of the pneumatic cleaning device 23. Preferably, the operation of the cleaning device is supported by the circulation blower 13 in a way such that the gases in the interior of the treatment chamber 1 are continuously circulated through the conduit 15, the filter 10, the conduit 16, the filter 14 and the conduit 16*a* back to the treatment chamber 1. Thereby, coarse particles entrained by the gas flow are removed in the filter 10 and fine particles entrained by the gas flow are removed in the filter 14. That circulation is maintained until the required purity of the gases is reached.

By means of the mechanism 3, the blowing tube member 24 can be swiveled in different directions with the result that the gas flow can be directed to selected areas of the treatment chamber 1 to optimize the cleaning operation.

To sum up, it is to be noted that the deflecting device 5 prevents loose particles as dust, powder particles, coating residues and the like from being whirled and entrained by the flow of gas generated due to the operation of the plasma spraying device 2, particularly during the coating operation. Such loose deposits are hold back in the collecting shaft 6 and/or removed from the gas flow by means of the filters 10, 14 and 16. In order to enable the treatment chamber 1 to be freed from possibly remaining deposits, the pneumatic cleaning device 23 is provided by means of which deposits on the walls of the treatment chamber 1 can be blown away and transported into the collecting shaft 6.

By means of the assembly described herein before, not only deposits are prevented from being whirled during the coating operation, but for example also in the case if a substrate is cleaned by means of the plasma spraying device 2 or if it is idling. During that cleaning operation, known to the person skilled in the art as "sputtering", an electric arc is created between the plasmatron and the substrate.

What is claimed is:

1. A plasma spraying assembly for treating the surfaces of substrates, comprising:

a treatment chamber means;

a vacuum pump means operatively connected to said treatment chamber means and adapted to create a subatmospheric pressure in an interior of said treatment chamber means;

a plasma spraying means mounted in the interior of said treatment chamber means;

an assembly for controlling the gas flow in the interior of said treatment chamber means;

said assembly for controlling the gas flow comprising a deflecting means located at least partially in the interior of said treatment chamber means and including a plurality of deflecting device means that are adapted to interfere with a gas flow in said treatment chamber means;

said assembly for controlling the gas flow further comprising a collecting shaft means located adjacent to and communicating with said treatment chamber means;

said deflecting means comprising a basic element means located in a transition area between said treatment chamber means and said collecting shaft means, said basic element means being provided with first baffle means and at least one passage means for a gas exchange between said treatment chamber means and said collecting shaft means.

2. An assembly according to claim 1 in which said deflecting means further comprises a deflection element means having essentially conical shape and towering at least partially into said passage means provided in said basic element means.

3. An assembly according to claim 1 in which said collecting shaft means is located vertically below said treatment chamber means.

4. An assembly according to claim 1 in which a top side of said basic element means towers above said collecting shaft means into said treatment chamber means.

5. An assembly according to claim 1 in which said basic element means comprises an outer dish member means tapered towards said collecting shaft means, the inner walls of said dish member means being provided with a plurality of said first baffle member means extending obliquely towards said collecting shaft means, whereby damming chamber means are formed at a back side of each of said first baffle member means.

6. An assembly according to claim 5 in which said dish member means has an essentially oval shape.

7. An assembly according to claim 1, said assembly for controlling the gas flow further comprising a circulation blower means, whereby said collecting shaft means is operatively connected to a suction side of said circulation blower means.

8. An assembly according to claim 1 in which said collecting shaft means is operatively connected to said vacuum pump means.

9. An assembly according to claim 7, said assembly for controlling the gas flow further comprising a conduit means and at least one filter means operatively inserted into said conduit means, one end of said conduit means being connected to said collecting shaft means and the other end thereof being connected to said suction side of said circulation blower means.

10. An assembly according to claim 1 in which said deflecting means further comprises second baffle member means located in the interior of said treatment chamber means.

11. An assembly according to claim 1 in which said plasma spraying means is located vertically above said basic element means.

12. An assembly according to claim 1 in which said plasma spraying means is fixed to a movable support means.

13. An assembly according to claim 1, further comprising a pneumatically operated cleaning means adapted to create a gas flow in the interior of said treatment chamber means, such that deposits in the interior of said treatment chamber means are transported into said collecting shaft means.

14. An assembly according to claim 13 in which said pneumatically operated cleaning means comprises a blowing tube means provided with a plurality of outlet apertures.

15. An assembly according to claim 14 in which said blowing tube means is mounted on said movable support means.

* * * * *